United States Patent [19]

Cizek

[11] 4,198,540

[45] Apr. 15, 1980

[54] COMPENSATED CROSSOVER NETWORK

[75] Inventor: Fred R. Cizek, Cambridge, Mass.

[73] Assignee: Cizek Audio Systems, Inc., Andover, Mass.

[21] Appl. No.: 886,628

[22] Filed: Mar. 15, 1978

Related U.S. Application Data

[63] Continuation of Ser. No. 689,454, May 24, 1976, abandoned.

[51] Int. Cl.[2] ..... H04R 3/04

[52] U.S. Cl. ..... 179/1 D

[58] Field of Search ..... 179/1 D, 115.5 PS

[56] References Cited

U.S. PATENT DOCUMENTS

| | | | |
|---|---|---|---|
| 2,802,054 | 8/1957 | Corney | 179/1 D |
| 3,457,370 | 7/1969 | Boner | 179/1 D |
| 3,814,857 | 6/1974 | Thomasen | 179/1 D |
| 3,838,215 | 9/1974 | Haynes, Jr. | 179/1 D |

*Primary Examiner*—Douglas W. Olms

*Attorney, Agent, or Firm*—Morse, Altman, Oates & Bello

[57] ABSTRACT

The signal from the crossover network of an audio output circuit is applied to certain of the audio system's low, middle and high frequency speakers through particular compensation circuits that are associated with the crossover network and the speaker driver coils. These compensation networks include: a resistor-inductor-capacitor sequence of selected values connected across the terminals of a high frequency or other driver whose resonant impedance peak must be compensated to a resistive impedance for optimum crossover; a resistor-capacitor sequence of selected values connected across the terminals of a low frequency or other driver whose inductance must be compensated to a resistive impedance for optimum crossover; and a variable inductor connected in series with one or more of the terminals of any driver where a "roll off" at higher frequency may be desired. The result is more faithful audio reproduction.

3 Claims, 5 Drawing Figures

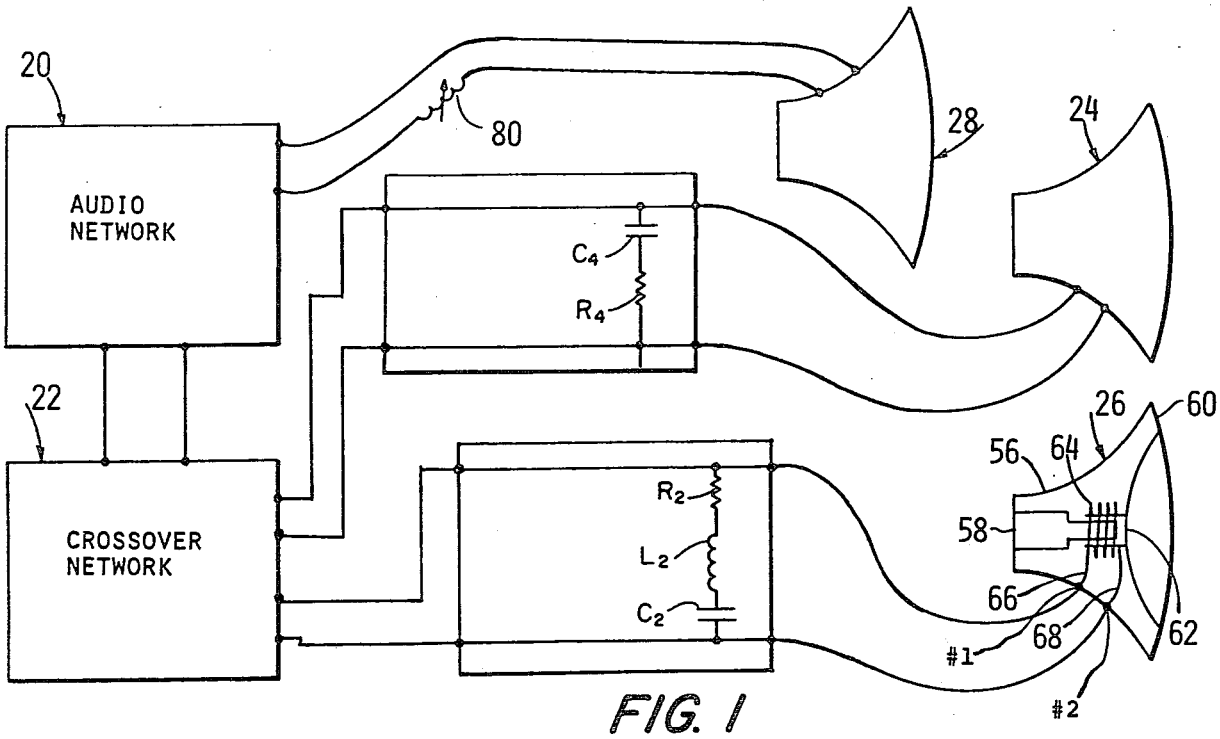
FIG. 1
FIG. 3
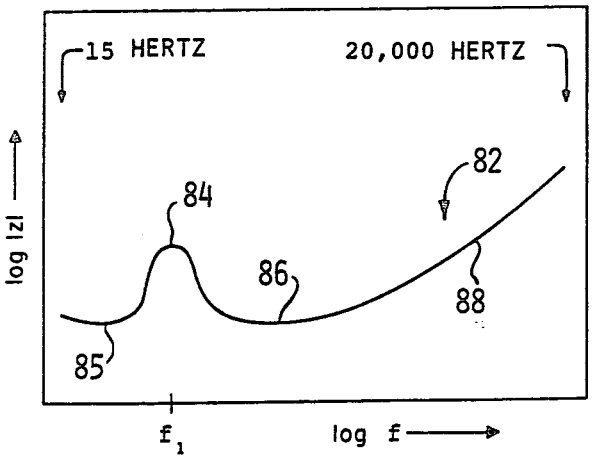
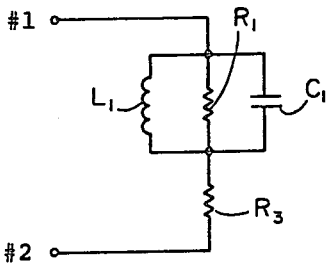
FIG. 2
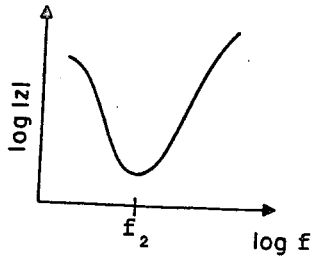
FIG. 4
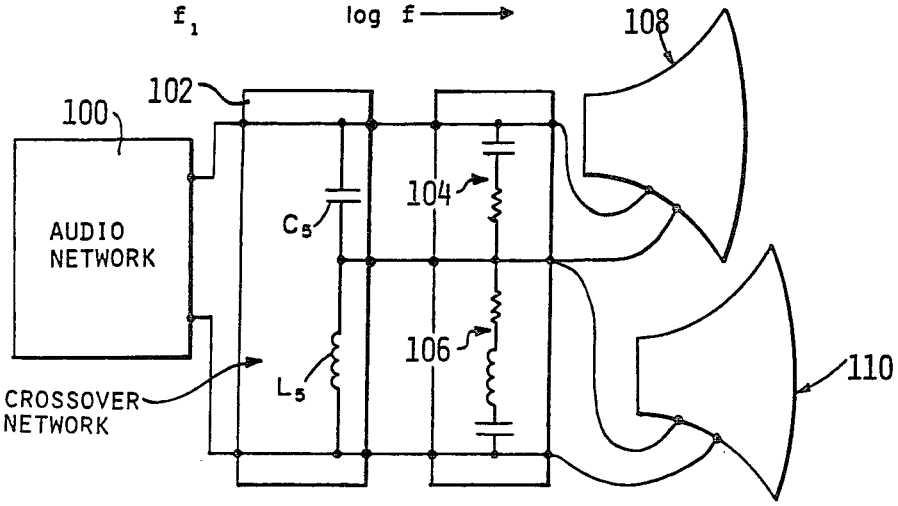
FIG. 5

COMPENSATED CROSSOVER NETWORK

This is a continuation of application Ser. No. 689,454 filed on May 24, 1976 now abandoned.

BACKGROUND

1. Field of the Invention

The present invention relates to audio systems, and more particularly, to audio circuitry of the type that filters the components of a signal from an audio amplifier of a radio terminal or an audio transducer to high frequency (tweeter), mid-range, and low frequency (woofer) dynamic speakers.

2. The Prior Art

Ordinarily, these audio signal components are filtered by a crossover network that is interposed between the audio amplifier and the speakers. It has been found that substantial distortion of frequency response, phase response, and transient response, as well as harmonic distortion, is introduced in the combination of amplifier output, crossover network, and the speakers because insufficient attention is given to their interactions.

SUMMARY OF THE DISCLOSED INVENTION

The primary object of the present invention is to associate specific compensation circuits with the crossover network and the driver coils. These compensation circuits include: a resistor-inductor-capacitor sequence of selected values connected across one or more high frequency or other driver coils of the type characterized by a requirement for compensation of a resonant impedance peak by conversion to resistive impedance; a resistor-capacitor sequence of selected values connected across one or more low frequency or other driver coils of the type characterized by a requirement for compensation of inductance by conversion to resistive impedance; and a variable inductor of selected value range connected in series with one or more of the driver coils. It has been found that critically improved audio fidelity is achieved when the system incorporates at least one of the resistor-inductor-capacitor and resistor-capacitor sequences, and particularly when the system incorporates both.

Other objects of the present invention will in part be obvious and will in part appear hereinafter.

The invention accordingly comprises the systems and circuits disclosed herein, together with their components and interrelationships, the scope of which will be indicated in the appended claims.

BRIEF DESCRIPTION OF THE DRAWINGS

For a fuller understanding of the nature and objects of the present invention, reference is made to the following detailed description, which is to be taken in connection with the accompanying drawings, wherein:

FIG. 1 is a part-block, part-schematic electrical diagram of a system embodying the present invention;

FIG. 2 is an equivalent circuit illustrating certain principles of the present invention;

FIG. 3 is a graphic diagram illustrating certain principles of the present invention;

FIG. 4 is a graphic diagram illustrating certain principles of the present invention; and FIG. 5 is a part block, part schematic electrical diagram of an alternative system embodying the present invention.

DETAILED DESCRIPTION OF THE PREFERRED EMBODIMENTS

As illustrated in FIG. 1, a preferred system embodying the present invention comprises an audio network 20, a crossover network 22, and a plurality of low frequency, middle frequency and high frequency dynamic speakers 24, 26, 28.

Typically, audio network 20, in one form, includes frequency modulated or amplitude modulated radio receiver circuitry and an output audio amplifier. Typically, audio network 20, in another form, includes a transducer pick-up for the spiral acoustically recorded grooves of a disk or the differentially magnetized ferromagnetic coat of a flexible polyethylene terephthalate tape. Typically, in one form, the crossover network is of the constant-voltage-transfer type described in "Constant-Voltage Crossover Network Design", Richard H. Small, Journal Of The Audio Engineering Society, January 1971, Vol. 19, No. 1, pages 12–19. Typically, in another form, the crossover network is of the constant resistance type described in *Electronics Reference Databook,* Normal Crowhurst, 1969, pages 131–135. Such networks, for operation in accordance with design, must be terminated by the appropriate resistive loads, particularly at frequencies close to the crossover frequency (±2 octaves). See: Small (supra), pp. 16–17; Crowhurst (supra), pp. 132, 133. But loudspeakers do not present a constant resistive load at all frequencies. Typically, each of dynamic speakers 24, 26, 28 includes a frame 56, on which are mounted a permanent magnet 58 at its rearward center recess, the periphery of a cone 60 at its periphery, and the periphery of a spider 62 at its forward center opening. Spider 62 is connected to the center of cone 60 and has a rearward sleeve, which surrounds magnet 58 and about which spirals a driver coil 64. Coil 64 has flexible electrical leads 66, 68 which are anchored on frame 56.

FIG. 3 is the curve, in terms of magnitude-of-impedence vs. frequency, of a typical dynamic loudspeaker, the ordinate being measured in log (ohms) and the abscissa being measured in log (hertz). This curve, generally designated 82, has a peak 84 at the loudspeaker's fundamental resonance and a steady rise 88 at high frequencies due to the inductance of the voice coil. There is a region 85 of relatively constant impedance at frequencies below the resonant frequency and a trough or valley region 86 between resonant peak 84 and rise 88.

In accordance with the present invention, if a loudspeaker is to be crossed over in the vicinity (±2 octaves) of its fundamental resonant frequency, electrical compensation for the resonant frequency impedence peak is achieved by placing, across the terminals of the driver (at the crossover network or the audio amplifier), an appropriate electrical compensation network so that the combination of loudspeaker and compensation network, taken together, present the crossover network or amplifier with a resistive termination in this frequency range. Near the fundamental frequency, the loudspeaker is equivalent electrically to the circuit of FIG. 2, which includes terminals #1 and #2, an inductor $L_1$, a resistor $R_1$, and a capacitor $C_1$, all in parallel, and a resistor $R_3$, in series. In the following discussion, inductance is measured in henries, capacitance in farads, resistance in ohms and frequency in hertz. The absolute impedance of this circuit at its resonant frequency $f_1$ is given by:

$$|Z_1| = R_1 + R_3$$

The absolute impedance of this circuit at low point 86 is given by:

$$|Z_{min}| = R_3$$

To compensate this loudspeaker to have a resistive impedance in the vicinity of its measured principal resonant frequency $f_1$, the resistor-inductor-capacitor sequence $R_2$, $L_2$, $C_2$ of FIG. 1 is connected in parallel across terminal #1 and #2 of loudspeaker 26. The impedance curve of this sequence is shown in FIG. 4. The values of $R_2$, $L_2$, $C_2$, in reference to the values of $R_1$, $L_1$, $C_1$, $R_1$, are computed from the actual impedance curve of the loudspeaker, in its baffle or enclosure as it ultimately is to be used, as follows:

$R_3$=the low-point value of the magnitude of the loudspeaker impedance above $f_1$. This generally gives a higher magnitude of low point impedance than that which would be measured below the $f_1$ resonant frequency. Equalizing to this higher value of $|Z|$ makes the impedance of the compensated drive resistive in the immediate vicinity of the principal resonant frequency and on upward into the piston band of the loudspeaker, and only allows a slight step-down in impedance at the relatively unimportant frequencies below the principal resonant frequency where loudspeaker output is falling off anyway. Equalizing to this higher impedance results in a compensated loudspeaker with greater SPL output for a constant power input than would be obtained by equalizing to the lower impedance measured below the resonant frequency or to the D.C. impedance. With a nominal 4 ohm 10 inch loudspeaker, for example, this difference in sensitivity was found to be close to 2 dB.

$R_1$=the high-point value of the magnitude of the loudspeaker impedance, at $f_1$, minus $R_3$.

Then:

$$C_1 = \frac{R_1\left(\frac{f_2^2}{f_1^2} - 1\right)\sqrt{P^2(R_1 + R_3)^2 - R_3^2}}{(2\pi f_2)(R_1 + R_3)\sqrt{1 - P^2}}$$

and $$L_1 = 1/4\pi^2 f_1^2 C_1;$$

Where:

$R_1$, $R_3$, and $f_1$ are as defined above and $f_2$ and P are defined as follows:

$f_2$=the lowest frequency above the resonant frequency $f_1$, at which the magnitude of the speaker impedance falls to a value equal to $R_3+R_1/2$; and $$P = \frac{R_3 + \frac{R_1}{2}}{R_3 + R_1}$$

Thus the compensation values are:

$$R_2 = R_3(R_1 + R_3)/R_1$$

$$L_2 = L_1 R_2^2$$

$$C_2 = C_1/R_2^2$$

This resonant frequency compensation circuit accomplishes a number of things.

(a) It makes the compensated loudspeaker's impedance essentially resistive in the area of its fundamental resonance so that theoretically calculated crossover networks will receive their proper resistive termination and will function according to design specifications.

(b) It serves as a parallel impedance to electro-magnetically damp the loudspeaker's principal resonance and to help prevent this resonance from becoming relatively undamped when the loudspeaker is used in a crossover with various series impedances inserted between the loudspeaker and the amplifier output terminals.

(c) Whether or not this compensation is used to facilitate crossing over a driver, it is believed that making the loudspeaker a resistive load on the amplifier improves fidelity by allowing a more efficient, problem free coupling of the loudspeaker to the amplifier output stage.

(d) By ensuring proper electro-magnetic damping of the loudspeaker's fundamental resonance and by providing the crossover with its proper termination, this compensation ensures that the mechanical excursion of the loudspeaker near resonance is properly controlled. This keeps harmonic and intermodulation destortion down.

If a loudspeaker is to be crossed over in the vicinity (±2 octaves) of the climbing impedance characteristic at high frequencies, in accordance with the present invention, it is desired to provide the crossover network (and/or the audio amplifier) with very nearly resistive termination through this frequency range. Here, a similar compensation sequence is used, in accordance with the present invention. This compensation also can be made to compensate at the same time for the inductance of any external series-inductor placed in series with a loudspeaker, such as is often used to lower the high frequency response of a woofer. To accomplish this additional compensation, the series inductor is simply considered as part of the woofer in all measurements. This compensation sequence includes a series combination of resistor $R_4$ and capacitor $C_4$, connected in parallel across the input terminals of the loudspeaker. The values for the compensation resistor and capacitor are calculated as follows from the measured impedance/frequency curve of the loudspeaker in its baffle or enclosure as it ultimately is to be used.

$R_4$=the magnitude of the measured loudspeaker A.C. impedance at the approximate minimum point 86 between the resonant frequency peak and the inductive impedance rise. This generally gives a higher magnitude of low point impedance than that which would be measured below the $f_1$ resonant frequency. Equalizing to this higher value of $|Z|$ makes the impedance of the compensated driver resistive in the immediate vicinity of the minimum point 86 and on upward in frequency through the audio band. Equalizing to this higher impedance results in a compensated loudspeaker with greater sound pressure level (SPL) output for a constant power input than would be obtained by equalizing to the lower impedance measured below the resonant frequency or to the D.C. impedance. With a nominal 4 ohm 10 inch loudspeaker, for example, this difference in sensitivity was found to be close to 2 dB.

$C_4 = 1/(2\pi R_4 f_3)$, where $R_4$ is as defined above and $f_3$ is the frequency at which the measured inductive impedance rise of the loudspeaker has reached a value 3 dB greater than $R_4$ (i.e., where $|Z| = \sqrt{2}R_4$). Due to losses in the loudspeaker inductance, this assures only approximately resistive compensation. In practice, the compensated impedance varies less than ±5%, resulting in a very significant improvement in crossover performance and speaker fidelity.

Comments (a) and (c) above apply to this compensation as well.

FIG. 5 illustrates a modification of the system of FIG. 1. This system comprises an audio network 100, a crossover network 102, a resistor-capacitor sequence 104 corresponding to resistor-capacitor sequence $C_4$, $R_4$ of FIG. 1, a resistor-inductor-capacitor sequence 106 corresponding to resistor-inductor-capacitor sequence $R_2$, $L_2$, $C_2$ of FIG. 1, and at least a pair of high and low frequency loudspeakers 108, 110 corresponding in their counterparts in FIG. 1. The system of of FIG. 1 includes a capacitor $C_5$ in parallel across resistor-capacitor sequence 104 and an inductor $L_5$ in parallel across resistor-inductor-capacitor sequence 106. This circuit is characterized as a first-order series crossover with constant voltage transfer, and constant resistance.

Here:

$$L_5 = R_5/2\pi f_5$$

and $$C_5 = \tfrac{1}{2}\pi f_5 R_5$$

Where:

$f_5$ is the crossover frequency and $R_5$ is the required terminating resistance of each of the two branches of the crossover.

The higher frequency response of the low frequency loudspeaker is mechanically or acoustically arranged to be approximately −3 dB at the crossover frequency and the low frequency response of the high frequency driver is arranged (in one embodiment by appropriate choice of resonant frequency and Q of resonance) to be likewise −3 dB at the crossover frequency. Both loudspeakers are electrically compensated to an approximately resistive impedance in the vicinity (±2 octaves) of the crossover. Then the crossover network reduces each of the drivers' responses by an additional −3 dB at the crossover frequency and acts to shift the phase of the signal to the high frequency driver a constant 90° ahead of the phase of the signal to the low frequency driver. If the two drivers now are arranged to be acoustically in phase (by appropriate loudspeaker driver design, especially by controlling the break-up at the high frequency of the low frequency loudspeaker diaphragm), for any steady sinusoidal signal (in the vicinity of the crossover for any frequency) applied to the loudspeaker system input terminals, the result is a system with flat response across the crossover region. Since the two drivers are operating in phase at the crossover region, the combined sound pressure level response is much less sensitive to any minor fluctuations in phase or amplitude response of the two individual loudspeakers than would be the case for drivers operating out of phase.

Compensating variable inductor 80 is intended to introduce a variable roll off of the response curve at its higher frequencies. The purpose of this roll off is to more closely imitate the conditions that exist in a large hall, where the higher frequencies are absorbed preferentially by the walls. Ordinarily, this inductor is designed to produce a roll off at in excess of 1,500 hertz and will have a value of at most 0.3 millihenrys.

The present invention thus contemplates: the parallel association of a resistor-capacitor-inductor sequence of selected values across certain of the drivers; the parallel association of a resistor-capacitor sequence of selected values across certain of the drivers; the optional serial association of a variable inductor of selected value with certain of the drivers; and the optical association of these compensation sequences in various combinations and permutations.

Since certain changes may be made in the foregoing disclosure without departing from the scope of the claims, it is intended that all matter contained in the foregoing specification or shown in the accompanying drawings be interpreted in an illustrative and not in a limiting sense.

What is claimed is:

1. In an audio system comprising an audio amplifier producing an audio output composite signal including at least a relatively low frequency component signal and at least a relatively high frequency component signal, a plurality of drivers including at least one relatively low frequency driver and at least one relatively high frequency driver, at least one crossover network for directing said relatively low frequency component signal to said relatively low frequency driver and said relatively high frequency component signal to said relatively high frequency driver:

(a) at least one compensation network connected across said low frequency driver, and at least another compensation network connected across said high frequency driver;

(b) said relatively low frequency driver being characterized by an absolute impedence vs. frequency response curve having a peak at relatively low frequencies, a trough thereafter and a rise at relatively high frequencies;

(c) said one compensation network converting the effective impedance of said low frequency driver to a resistance;

(d) said one compensation network including a resistor-inductor-capacitor series sequence across said low frequency driver;

(e) said low frequency driver constituting a circuit that is equivalent to an inductor $L_1$, a resistor $R_1$ and a capacitor $C_1$, all in parallel, and a resistor $R_3$, in series;

(f) said resistor-inductor-capacitor sequence being designated $R_2$, $L_2$, $C_2$ and being selected in accordance with the following expressions $|Z_1| = R_1 + R_3$, $|Z_1|$ being the absolute impedance of said low frequency driver at resonance $f_1$, $|Z_{min}| = R_3$, $|Z_{min}|$ being the absolute impedance at the approximate low point of the impedance curve of said low frequency driver, $R_3$ = the approximate low point value of the magnitude of impedance above $f_1$ of said low frequency driver, said low point value being higher than that which would be measured below $f_1$, $R_1$ = the high point value of the magnitude of impedance of said low frequency driver at $f_1$ minus $R_3$, $R_2 = R_3(R_1 + R_3)/R_1$, $L_2 = L_1 R_2^2$, and $C_2 = C_1/R_2^2$;

(g) said high frequency driver having a measured low point impedance at the approximate minimum point between a resonant frequency peak and an inductive impedance rise of its characteristic curve;

(h) said other compensation network including a resistor-capacitor series sequence across said high frequency driver;

(i) said resistor-capacitor series sequence being designated $R_4$, $C_4$, and being selected in accordance with the following expressions $R_4$ = the magnitude of said measured low point impedance of said high frequency driver at said approximate minimum point between said resonant frequency peak and said inductive impedance rise of said characteristic curve, said low point impedance being greater than that which would be measured below the resonant frequency; and $C_4 = 1/(2\pi R_4 f_3)$, where $R_4$ is as defined above and $f_1$ is the frequency at which the measured inductive impedance rise of said high frequency driver has reached a value greater than $|Z| = \sqrt{2}R_4$;

(j) said one compensation network and said low frequency driver thereby having a compensated impedance that is essentially resistive in the region of its fundamental resonance and having a damped fundamental resonance;

(k) said other compensation network and said high frequency driver thereby having a compensated impedance that is essentially resistive.

2. The audio system of claim 1 wherein said one crossover network includes an inductor $L_5$ across said resistor-inductor-capacitor series sequence and said other crossover network includes a capacitor $C_5$ across said resistor-capacitor series sequence, in accordance with the following expressions $L_5 = R_5/2\pi f_5$; $C_5 = \frac{1}{2}\pi f_5 R_5$; $f_5$ = the crossover frequency; and $R_5$ = the terminating resistance of each of the two branches of the crossover network.

3. The audio system of claim 1 wherein a variable inductor is in series with at least one of said drivers.

* * * * *